United States Patent [19]

Poletto

[11] Patent Number: 4,714,652

[45] Date of Patent: Dec. 22, 1987

[54] PROCESS FOR FIRE-PROOFING POROUS SYNTHETIC SHEET MATERIAL PARTICULARLY ARTIFICIAL LEATHER

[75] Inventor: Giorgio Poletto, Cirié, Italy

[73] Assignee: Lorica S.p.A., Italy

[21] Appl. No.: 898,817

[22] Filed: Aug. 15, 1986

Related U.S. Application Data

[63] Continuation-in-part of Ser. No. 741,283, Jun. 4, 1985, abandoned.

[30] Foreign Application Priority Data

Jun. 6, 1984 [IT] Italy ..... 67584 A/84

[51] Int. Cl.[4] ..... B05D 5/00; B32B 5/14; B32B 27/00; B32B 27/40

[52] U.S. Cl. ..... 428/308.4; 427/244; 427/246; 428/423.3; 428/904; 428/921; 528/491

[58] Field of Search ..... 427/244, 246; 428/308.4, 423.3, 904, 921; 528/491

[56] References Cited

U.S. PATENT DOCUMENTS

| | | | |
|---|---|---|---|
| 3,419,344 | 12/1968 | Jones | 8/94.23 |
| 3,582,393 | 6/1971 | Skikada | 427/246 |
| 3,600,209 | 8/1971 | Young | 427/246 X |
| 3,645,775 | 2/1972 | Schulze et al. | 427/246 X |
| 4,256,786 | 3/1981 | Dias et al. | 427/244 |

FOREIGN PATENT DOCUMENTS

| | | |
|---|---|---|
| 2487184 | 1/1982 | France . |
| 2084622 | 4/1982 | United Kingdom . |

*Primary Examiner*—Michael R. Lusignan
*Attorney, Agent, or Firm*—Michael N. Meller

[57] ABSTRACT

Process particularly suitable for artificial leather of the type whereby a porous polyurethane resin matrix containing polyester and/or polyethylene fibers is covered with a compact, pressed polyurethane resin film, and consists of treating the artificial leather in rotary tanning drums, firstly, with a relatively concentrated solution of water and PIROFLAM (registered trade mark) or other similar commercial fireproofing/retarding substance of the type commonly employed for extinguishing forest fires, and, secondly, with a solution of water and softener, e.g. TRIANOL SP (registered trade mark) to which is added an appropriate amount of the same fireproofing/retarding substance used previously on the artificial leather.

11 Claims, No Drawings

PROCESS FOR FIRE-PROOFING POROUS SYNTHETIC SHEET MATERIAL PARTICULARLY ARTIFICIAL LEATHER

This application is a continuation-in-part of application Ser. No. 741,283, filed June 4, 1985, now abandoned.

BACKGROUND OF THE INVENTION

The present invention relates to a process for fireproofing porous synthetic sheet material, particularly material comprising a porous polyurethane matrix, embedded with polyester, polyamide and/or polyethylene fibers, and a cover film of compact polyurethane resin. The present invention relates, in particular, to a process for fireproofing the many types of synthetic sheet material currently available on the market under various trade names and commonly known as "artificial leather", i.e. commonly used as artificial leather in place of real leather for upholstery, clothing, shoes and similar.

Most types of artificial leather normally used in industry and currently available on the market are generally known to be made using appropriate polymer resins, usually polyurethane, foam and/or porous resins (i.e. having microscopic pores visible only under an electronic microscope) which, unlike real leather, are all highly inflammable. The inflammable nature of the said known types of sheet material and the relatively harmful nature of the fumes produced when they are burned are two of the major reasons preventing their widespread employment, particularly in public premises such as theatres, cinemas, etc. Though various chemical additives exist which may be added to the said polymer resins of which the said artificial leather is formed, or which may be applied to the same at a later stage, such additives merely provide for retarding combustion of the said artificial leather and in no way provide for rendering it fireproof. Consequently, the danger underlying the said material, using known fireproofing processes, is simply reduced, not eliminated. Furthermore, the employment of fireproofing additives greatly impairs the appearance of the said artificial leather the scope of which is thus reduced.

SUMMARY OF THE INVENTION

The aim of the present invention is to provide a process for fireproofing porous synthetic sheet material, particularly artificial leather, which enables the said material to be processed after manufacture, i.e. in semifinished form, and which, in addition to providing for full fireproofing of the same, has essentially no effect on its appearance.

With this aim in view, the present invention relates to a process for fireproofing porous synthetic sheet material, particularly material comprising a porous polyurethane matrix, and a compact, polyurethane resin film, characterized by the fact that the said process comprises stages whereby:

the said sheet material is treated with a fireproofing solution consisting of a solution of water and 24% up to 60% of a fireproofing/retarding substance, preferably of the type commonly used for extinguishing forest fires, containing amonium salts in such a manner as to permeate the entire section of the said sheet material;

the said sheet material is than treated with a softening solution of water and 8% up to 20% by weight of at least one commercial softening substance, preferably of the type employed in softening laundry, containing a linear hydrocarbon chain of about 12 up to 18 carbon atoms coupled with a radical selected from the group consisting of $-SO_3X$ wherein X is an alkali metal, and $-(OCH_2CH_2)_YOH$ wherein Y is an integer comprised between 1 and 18, to which is added an appropriate amount of the same commercial fireproofing/retarding substance used previously on the said sheet material.

DETAILED DESCRIPTION OF THE INVENTION

Numerous experiments conducted by the present Applicant have shown that, by treating the artificial leather currently sold on the market, or rather, the semifinished material from which the same is formed and consisting of pitted/porous, polymer-based synthetic sheet material, with a particular group of commercial fireproofing/retarding products devised and employed, not as additives for polymers or manufactured items, but as extinguishing substances, particularly for extinguishing forest fires by means of spraying from the air, the said substances were retained by the said porous synthetic material or "artificial leather" inside the said pores and on any strengthening fibres contained in the porous matrix, in such a manner as to render the said material totally fireproof. The present Applicant has also discovered, however, that processing the said synthetic sheet material using only the said fireproofing/retarding substances had a drastic effect on the appearance of the said material. In particular, when treated with the said substances, the said synthetic sheet material became so stiff and dull as to be totally unusable. Following further experiments, however, the present Applicant has discovered that, by combining the said first process, whereby the said synthetic sheet material is treated with the said fireproofing/retarding substances, with a subsequent process using solutions of water and commercial softening substances of the type commonly sold and employed for softening machine-washed fabrics, the said porous synthetic material was rendered totally fireproof, regardless of its chemical nature, and with no impairment in the softness or appearance of the starting material. Experiments conducted by the present Applicant have also shown that, in order to maintain total fireproofing of artificial leather treated according to the present process, the softening solution, applied subsequent to the first stage using the said fireproofing/retarding substance, should be charged with an appropriate amount of the same commercial fireproofing/retarding substance used previously on the artificial leather or semifinished material of which the same is formed and consisting of the said porous synthetic sheet material. It has been shown, in fact, that adding a given percentage of the said fireproofing/retarding substance to the said softening solution prevents the latter from dissolving, i.e. removing, part of the fireproofing substance previously absorbed by the porous matrix on the processed sheet material. The best results were shown to be given by tying the material up into appropriately-sized bales, loading the latter inside rotary drums of the type commonly used for tanning real leather, starting up the drums and feeding into the latter the various processing solutions, the active substances employed being a formula known by the trade name of PIROFLAM (registered trademark) for the actual fireproofing process, and a formula known by the trade name of TRIANOL SP (registered trademark), to which a given quantity of PIROFLAM is added, for the subsequent softening process. As the chemical formula of the said trade substances is unknown to the present Applicant, hereinafter, reference will be made simply to their trade names. PIROFLAM, and TRIANOL SP, which is used for making the well known fabric softener VERNEL (registered trademark) are dissolved in water, the former to produce a relatively strong solution and the latter at a much lower concentration. Though the exact chemical composition of these two commercial products is not known, as stated above, it is known as a matter of fact that PIROFLAM contains ammonium salts and, particularly, ammonium polyphosphates to which organic chemical compounds able to yield $NH_3$ and/or C are added; and that TRIANOL SP contains linear hydrocarbons polymerized with ethylene oxide in order to form epoxylated polymers of about 12 to 18 carbon atoms, i.e. contains a chemical compound having the structure of a non-ionic synthetic detergent.

On the grounds of above, the Applicant experimented with a certain number of other chemical compounds or products having a chemical nature like those PIROFLAM and TRIANOL SP are known to have. Particularly the process according to the present invention has been carried out not only using solutions of PIROFLAM and TRIANOL SP but also solutions of some polyphosphates as $(NH_4)_5P_3O_{10}$ and $(NH_4PO_3)_6$ mixed with guanidine, pentaerythritol and/or chlorinated rubber in place of PIROFLAM; and using solutions of lauric epoxylate, palmitic epoxylate, myristic epoxylate, stearic epoxylate and of sodium salts of chloro-suphonated n-paraffins having a linear hydrocarbon chain of about 12 up to 18 carbon atoms in place of TRIANOL SP; on the grounds of the results obtained, all the aforementioned compounds used in place of PIROFLAM and TRIANOL SP have been demonstrated to be vicariant of PIROFLAM and TRIANOL SP; therefore it is assumed that any other product currently or in future available on the market and having essentially the same characteristics may be employed for the present process by way of alternatives to the aforementioned products without detracting from the excellent results provided for by the present process. More particularly, though the sodium salts of sulphonated lauric, palmitic, myristic and stearic alcohols and the epoxylates of the same alcohols have been the only substances tested, it is clear to to any skilled person that any substance containing a linear hydrocarbon chain of about 12 up to 18 carbon atoms coupled with a radical selected from the group consisting of $—SO_3X$, wherein X is any alkali metal, even different from Na (e.g. K or Li), and $—(OCH_2CH_2)_yOH$, wherein y is an integer from 1 to 18, can be used in place of TRIANOL SP with the same results.

According to the present invention, the material, tied up into bales, is placed inside the said tanning drums and first subjected to a "soaking" process consisting in dampening the material with water, containing surface-active substances, by turning it inside the drums for about 20 minutes at 60° C. This "soaking" process provides for wetting the material thoroughly so as to enable thorough absorption of the active solutions to be applied later. The water and surface-active substance solution is then drained off and the rotary drum filled with the first processing solution, preferably consisting of water and 60% by weight of PIROFLAM. In the said water and PIROFLAM solution, the material is then turned inside the drum for about 30 minutes, or long enough for the solution to soak through the entire section of the material and fill most of the pores in the synthetic matrix on the same. Finally, the said first solution is also drained off and the rotary drum filled with the second, i.e. softening, solution preferably consisting of water and 20% by weight of TRIANOL SP to which is added also 20% by weight of PIROFLAM. The softening process is conducted inside the turning drum for about 15 minutes, after which, the second solution is also drained off and the processed material dried in hot air at about 70° C., the latter possibly being blown straight into the rotary drum.

Following such processing, the artificial leather or corresponding semifinished synthetic sheet material may be unloaded and rolled up on strips ready for normal finish processing in the known manner; the starting material being essentially unchanged in terms of softness and appearance but, thanks to the process according to the present invention, essentially fireproof. Finally, the process covered by the present invention may ideally form an integral part of a much broader process covered in a separate patent application filed by the present Applicant on the same date and entitled "Process for producing artificial leather similar to real leather by chemically processing synthetic sheet material"; the said broader process, starting essentially from known types of semifinished material consisting of the said polyurethane-resin-based, porous synthetic sheet material, enabling the production of artificial leather all in all identical to real leather in terms of softness, appearance and consistency and being highly flexible and totaly fireproof; the said broader process thus enabling the employment of artificial leather in industrial and commercial sectors, i.e. for upholstery, clothing, shoes, etc., heretofore dominated exclusively by real leather. The process according to the present invention is particularly successful when applied to a particular class of artificial leather the semifinished starting material of which consists of a sheet material comprising a porous, polyurethane-resin matrix, embedded with polyester, polyamide and/or polyethylene fibers, and a pressed, compact, polyurethane-resin film patterned in such a manner as to imitate real leather.

The process according to the present invention will now be described by way of a number of non-limiting examples.

EXAMPLE I

Twelve 10 m long strips of 1 mm thick porous, synthetic sheet material, consisting of a porous, polyurethane-resin-foam matrix with a pressed, compact, polyurethane-resin cover film coated on to the said foam matrix, were folded and tied up into twelve 250×120×120 cm bales and loaded inside a rotary tanning-type drum of about 5.6 cubic meters in volume. After loading, the said drum was filled with 650 liters of water containing surfaceactive substances and the solution brought up to 60° C. The drum was then turned at a speed of 15 rpm for 20 minutes, after which, the water and surface-active substance solution was drained off and the drum filled with 262.5 liters of a solution consisting of water and 60% by weight of PIROFLAM (registered trade mark). The bales were treated in the said solution inside the rotary drum for about 30 minutes, by which time, as shown by sample pieces of material taken off the said bales, the entire section of the processed sheet material had been fully permeated by the processing solution. The said water and PIROFLAM solution was then drained off and the said 12 bales subjected, still inside the same rotary drum, to 56.25 liters of solution consisting of water and 20% by weight of PIROFLAM plus 20% by weight of TRIANOL SP (registered trade mark) for 15 minutes. Finally, the said second solution was also drained off and the sheet material dried by blowing hot air at a temperature of 70° C. into the drum turning at a speed of about 6 rpm. After processing, the 12 bales were undone and the processed sheet material, which looked and felt exactly the same as before processing, was rolled up.

EXAMPLE II

The same method described in Example I, the same amounts of the same solutions and the same processing times were applied to twelve 10 m long strips of 1.2 mm thick porous, synthetic sheet material consisting of a porous, polyurethane-resin matrix embedded with numerous polyester-resin strengthening fibers and covered with a compact, polyurethane-resin film. Such a material is produced and sold by the Japanese firm "Kuraray Co. Ltd", 1-12-39 Umeda, Kita-Ku Oshaka 530, Japan, and is the semifinished material from which the artificial leather marketed under the trade name of SOFRINA is made. After processing, 20×20 cm samples were taken off the 12 processed strips and combustion-tested as per Standard Federation standards n°302 (horizontal test pieces), the results of which are shown in Table I.

TABLE I

| Test piece | Combustion speed (mm/min) |
|---|---|
| 1 | zero |
| 2 | zero |
| 3 | zero |
| 4 | zero |
| 5 | zero |

EXAMPLE III

Using the semifinished material consisting of the synthetic starting material in Example II, five 20×20 cm test pieces of totally-unprocessed synthetic sheet material were prepared and combustion-tested as per Standard Federation standards n°302 (horizontal test pieces). At the same time, five identical 20×20 cm test pieces were taken from a strip of finished, commercial type artificial leather consisting of porous, synthetic sheet material of the same type as that processed according to the present invention in Example II but, in this case, treated using known types of fireproofing processes. The samples of untreated synthetic sheet material were numbered 6 to 10 and those of finished synthetic material, known by the trade name of SOFRINA, numbered 11 to 15. The results are shown in Table II.

TABLE II

| Test piece | Combustion speed (mm/min) |
|---|---|
| 6 | 200 |
| 7 | 220 |
| 8 | 210 |
| 9 | 220 |
| 10 | 210 |
| 11 | 180 |
| 12 | 182 |
| 13 | 181 |

TABLE II-continued

| Test piece | Combustion speed (mm/min) |
|---|---|
| 14 | 181.5 |
| 15 | 183 |

As shown in Tables I and II, the same synthetic sheet material, subjected to no processing or finishing, presents an extremely high combustion rate, essentially such as to cause practically instantaneous combustion of the material. On the other hand, the same material finished in such a manner as to be commercially employable and treated using known fireproofing processes (test pieces 11 to 15) presents a slower combustion rate as compared with the untreated material, but very high just the same and high enough to impair its commercial use drastically. The unfinished material processed according to the present invention (test pieces 1 to 5 in Table I), on the other hand, presents a combustion rate of nil, i.e. is totally fireproof.

"PIROFLAM" is a registered trademark applied to a product sold by the Italian firm PROMETEO and containing polyphosphates chemically coupled to an organic compound. "TRIANOL" is a registered trademark applied to a product sold by the U.S. firm HENKEL and containing linear hydrocarbons polymerized with ethylene oxide to produce epoxylated polymers of about 12 to 18 carbon atoms.

EXAMPLE IV

After processing, 20×20 cm samples were taken off the 12 processed strips of EXAMPLE I and combustion tested as in EXAMPLE II, the results of which are shown in table III.

TABLE III

| Test Piece | Combustion Speed (mm/min.) |
|---|---|
| 1 | zero |
| 2 | zero |
| 3 | zero |
| 4 | zero |
| 5 | zero |

EXAMPLE V

Acting just as described in Example I strips of the same synthetic sheet material of Example I were treated using as the fireproofing solution an aqueous solution of 24% by weight of PIROFLAM and then, with a softening solution consisting of an aqueous solution of 8% by weight of TRIANOL SP and 8% by weight of PIROFLAM. After processing three 20×20 cm samples were taken off the processed strips and combustion tested as in EXAMPLE II.

The results are contained in Table IV.

TABLE IV

| Test piece | Combustion Speed (mm/min.) |
|---|---|
| 1 | zero |
| 2 | zero |
| 3 | zero |

EXAMPLE VI

Acting as described in EXAMPLE V the strips of synthetic material were treated with a fireproofing solution of 20% by weight of PIROFLAM and then with the same softening solution of EXAMPLE V. The results are in TABLE V, from which it is evident that under the 24% by weight of PIROFLAM in the fireproofing solution the fireproofing effect is lessened, but the combustion speed is still lower than those of the untreated material or of the materials treated with known processes.

TABLE V

| Test Piece | Combustion Speed (mm/min.) |
|---|---|
| 1 | 0.1 |
| 2 | 1 |
| 3 | 0.5 |

EXAMPLE VII

Operating just as described in EXAMPLE II, the synthetic sheet material of EXAMPLE II was treated using different fireproofing and softening solutions, of different chemical nature and compositions and three 20×20 mm samples of the processed material were taken off from the processed strips for each pair of fireproofing-softening solutions employed; the samples were marked with a code consisting two progressive numbers separated by an hyphen '-', the first number indicating the pair of treating solutions employed and the second number indicating the progressive number of the samples treated with the same solutions. The solutions employed and their composition are contained in TABLE VI, wherein each pair of treating solutions is indicated with the same number used as the first number for the code of the samples of material treated with such solutions. In Table VII are the results of the combustion tests conducted on the samples treated with the solutions of Table VI operating just as in EXAMPLE II.

TABLE VII

| Test piece | Combustion Speed (mm/min.) |
|---|---|
| 1-1 | zero |
| 1-2 | " |
| 1-3 | " |
| 2-1 | " |
| 2-2 | " |
| 2-3 | " |
| 3-1 | " |
| 3-2 | " |
| 3-3 | " |
| 4-1 | " |
| 4-2 | " |
| 4-3 | " |
| 5-1 | " |
| 5-2 | " |
| 5-3 | " |
| 6-1 | " |
| 6-2 | " |
| 6-3 | " |
| 7-1 | " |
| 7-2 | " |
| 7-3 | " |
| 8-1 | " |
| 8-2 | " |
| 8-3 | " |
| 9-1 | " |
| 9-2 | " |
| 9-3 | " |
| 10-1 | " |
| 10-2 | " |
| 10-3 | " |

I claim:

1. A process for fireproofing porous synthetic sheet material comprising a porous polyurethane matrix and a compact polyurethane resin film, said process comprising the steps of:

treating said sheet material with a fireproofing solution consisting of a solution of water and 24% up to

TABLE VI

| No. | Type of Fireproofing Agents | | Type of Softening Agents | Fireproofing Solution % by weight | | Softening solution % by weight | | |
|---|---|---|---|---|---|---|---|---|
| | | | | Fireproofing Ag. | Water | Soft. Ag. | Fireproofing Ag. | Water |
| 1 | $(NH_4PO_3)_6$ | 310 gr. | $C_{12}H_{25}OSO_3Na$ | 40 | q.b. | 10 | 8 | q.b. |
| | guanidine | 200 gr. | | | | | | |
| 2 | $(NH_4PO_3)_6$ | 310 gr. | $C_{18}H_{37}OSO_3Na$ | 50 | q.b. | 15 | 15 | q.b. |
| | guanidine | 200 gr. | | | | | | |
| | pentaerythritol | 90 gr. | | | | | | |
| 3 | $(NH_4)_5P_3O_{10}$ | 300 gr. | $C_{16}H_{33}(OCH_2CH_2)_8OH$ | 35 | q.b. | 10 | 10 | q.b. |
| | guanidine | 200 gr. | | | | | | |
| | pentaerythritol | 90 gr. | | | | | | |
| 4 | $(NH_4)_5P_3O_{10}$ | 310 gr. | $C_{12}(OCH_2CH_2)_6OH$ | 55 | q.b. | 18 | 17 | q.b. |
| | pentaerythritol | 90 gr. | | | | | | |
| | $(NH_4PO_3)_6$ | 200 gr. | | | | | | |
| 5 | $(NH_4)_5P_3O_{10}$ | 310 gr. | $C_{16}H_{33}OSO_3Na$ | 48 | q.b. | 15 | 15 | q.b. |
| | guanidine | 200 gr. | | | | | | |
| 6 | $(NH_4)_5P_3O_{10}$ | 310 gr. | $C_{18}H_{37}OSO_3Na$ | 60 | q.b. | 20 | 18 | q.b. |
| | guanidine | 200 gr. | | | | | | |
| | pentaerythritol | 90 gr. | | | | | | |
| | chlor. rubber | 3,5 gr. | | | | | | |
| 7 | $(NH_4)_5P_3O_{10}$ | 310 gr. | $C_{18}H_{37}(OCH_2CH_2)_{12}OH$ | 30 | q.b. | 10 | 10 | q.b. |
| | guanidine | 200 gr. | | | | | | |
| | pentaerythritol | 90 gr. | | | | | | |
| 8 | $(NH_4)_5P_3O_{10}$ | 310 gr. | $C_{12}H_{37}(OCH_2CH_2)_8OH$ | 60 | q.b. | 20 | 20 | q.b. |
| | guanidine | 200 gr. | | | | | | |
| | pentaerythritol | 90 gr. | | | | | | |
| 9 | $(NH_4PO_3)_6$ | 310 gr. | $C_{18}H_{37}(OCH_2CH_2)_8OH$ | 60 | q.b. | 20 | 20 | q.b. |
| | guanidine | 200 gr. | | | | | | |
| | pentaerythritol | 90 gr. | | | | | | |
| | chlor. rubber | 3,5 gr. | | | | | | |
| 10 | $(NH_4PO_3)_6$ | 310 gr. | $C_{12}H_{25}(OCH_2CH_2)_8OH$ | 60 | q.b. | 20 | 20 | q.b. |
| | guanidine | 200 gr. | | | | | | |
| | pentaerythritol | 90 gr. | | | | | | |
| | chlor. rubber | 3,5 gr. | | | | | | |

60% by weight of any fireproofing/retarding substance, preferably of the type employed in extinguishing forest fires, containing ammonium salts, in such a manner as to permeate the entire section of said sheet material;

and then treating said sheet material with a softening solution consisting of a solution of water and 8% up to 20% by weight of any softening substance, preferably of the type employed in softening laundry, containing a linear hydrocarbon chain of about 12 up to 18 carbon atoms coupled with a radical selected from the group consisting of $—SO_3X$ wherein X is an alkali metal, and $—(OCH_2CH_2)_yOH$ wherein y is an integer comprised between 1 and 18; in said softening solution being added an appropriate amount of the same fireproofing/retarding substance contained in said fireproofing solution.

2. The process according to claim 1, wherein the said softening solution contains 8% up to 20% by weight of the same fireproofing/retarding substance contained in said fireproofing solution.

3. The process according to claim 2, wherein said fireproofing/retarding substance consists of a mixture of ammonium polyphosphates added with chemical compounds able to yield $NH_3$ and/or C.

4. The process according to claim 1, wherein said sheet material is first treated with an aqueous solution of PIROFLAM (registered trademark) for about 30 minutes, and then with an aqueous solution of TRIANOL SP (registered trademark) containing PIROFLAM, for about 15 minutes.

5. The process according to claim 4, wherein said sheet material is treated with an aqueous solution of 60% by weight of PIROFLAM and then with an aqueous solution of 20% by weight of TRIANOL SP and 20% by weight of PIROFLAM.

6. The process according to claim 1, wherein said sheet material, tied into appropriately-sized bales, is placed inside tanning-type drums which are then turned and inside which said solutions are successively fed.

7. The process according to claim 1, wherein said sheet material is first soaked with water, containing surface-active substances, for about 20 minutes at a temperature of about 60° C.

8. The process according to claim 1, wherein said sheet material is finally dried using hot air.

9. Artificial leather for manufacturing clothing, shoes, upholstery and similar, treated according to the fireproofing process of claim 1.

10. The process according to claim 1, wherein said sheet material is treated with said fireproofing/retarding solution for about 30 minutes, and then with said softening solution for about 15 minutes.

11. The process according to claim 1, wherein said synthetic sheet material comprises a matrix in which fibers selected from the group consisting of polyester, polyamide and polyethylene fibers are embedded.

* * * * *